US008675896B2

(12) United States Patent
Choi

(10) Patent No.: US 8,675,896 B2
(45) Date of Patent: Mar. 18, 2014

(54) APPARATUS AND METHOD FOR AUDIO SIGNAL PROCESSING IN DUAL STANDBY MOBILE COMMUNICATION TERMINAL

(75) Inventor: Sung-Yun Choi, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 238 days.

(21) Appl. No.: 12/970,091

(22) Filed: Dec. 16, 2010

(65) Prior Publication Data

US 2011/0158438 A1 Jun. 30, 2011

(30) Foreign Application Priority Data

Dec. 24, 2009 (KR) ..... 10-2009-0130676

(51) Int. Cl.
*H04R 3/00* (2006.01)

(52) U.S. Cl.
USPC ..... 381/122; 455/3.06; 455/557; 375/220; 375/222

(58) Field of Classification Search
USPC ..... 455/3.06, 102, 557; 381/122; 375/220, 375/222
See application file for complete search history.

(56) References Cited

U.S. PATENT DOCUMENTS

| | | | | |
|---|---|---|---|---|
| 7,774,018 | B2 * | 8/2010 | Oh | 455/550.1 |
| 2007/0155426 | A1 * | 7/2007 | Balakrishnan et al. | 455/556.2 |
| 2008/0125180 | A1 * | 5/2008 | Hoffman et al. | 455/566 |
| 2009/0054075 | A1 * | 2/2009 | Boejer et al. | 455/456.1 |

* cited by examiner

*Primary Examiner* — Disler Paul
(74) *Attorney, Agent, or Firm* — Jefferson IP Law, LLP

(57) ABSTRACT

An apparatus and method for processing an audio signal in a dual standby mobile communication terminal are provided. The apparatus includes a first modem for supporting a first system and for outputting an interrupt signal that requests audio signal processing when a call for the first system is generated, and a second modem for supporting a second system, for receiving the interrupt signal that requests the audio signal processing from the first modem, and for performing digital signal processing of the audio signal for the first system.

16 Claims, 3 Drawing Sheets

APPARATUS AND METHOD FOR AUDIO SIGNAL PROCESSING IN DUAL STANDBY MOBILE COMMUNICATION TERMINAL

PRIORITY

This application claims the benefit under 35 U.S.C. §119 (a) of a Korean patent application filed in the Korean Intellectual Property Office on Dec. 24, 2009 and assigned Ser. No. 10-2009-0130676, the entire disclosure of which is hereby incorporated by reference.

BACKGROUND OF THE INVENTION

1. Field of the Invention

The present invention relates to a dual standby mobile communication terminal. More particularly, the present invention relates to an apparatus and method for processing an audio signal transmitted/received in the dual standby mobile communication terminal.

2. Description of the Related Art

Dual standby mobile communication terminals that simultaneously support two networks have recently been developed. The dual standby mobile communication terminal may simultaneously support the two networks by periodically measuring signals of Base Stations (BSs) corresponding to the two networks even if the terminal operates in a standby mode.

FIG. 1 is a block diagram illustrating a dual standby mobile communication terminal according to the related art.

Referring to FIG. 1, to simultaneously support two networks, the dual standby mobile communication terminal employs two modems 100 and 102. The two modems 100 and 102 share an audio path for voice telephony by means of analog switches 122 and 124. The voice telephony uses a microphone 120, a speaker 126, and the like.

A problem exists in that a Printed Circuit Board (PCB) layout becomes complicated since the analog switches 122 and 124 are additionally required in the dual standby mobile communication terminal. Further, since the dual standby mobile communication terminal uses a master modem with high performance and a slave modem with low performance in general, audio volume and audio quality of audio signals have to be tuned for each modem in voice telephony because the two modems have different performances.

SUMMARY OF THE INVENTION

An aspect of the present invention is to address at least the above-mentioned problems and/or disadvantages and to provide at least the advantages described below. Accordingly, an aspect of the present invention is to provide an apparatus and method for processing an audio signal transmitted/received in a dual standby mobile communication terminal.

Another aspect of the present invention is to provide an apparatus and method for processing an audio signal transmitted/received through two networks by using a single modem in a dual standby mobile communication terminal.

In accordance with an aspect of the present invention, an apparatus for processing an audio signal in a dual standby mobile communication terminal is provided. The apparatus includes a first modem for supporting a first system and for outputting an interrupt signal that requests audio signal processing when a call for the first system is generated, and a second modem for supporting a second system, for receiving the interrupt signal that requests the audio signal processing from the first modem, and for performing digital signal processing of the audio signal for the first system.

In accordance with another aspect of the present invention, a method for processing an audio signal in a dual standby mobile communication terminal is provided. The method includes outputting, by a first modem supporting a first system, an interrupt signal that requests audio signal processing to a second modem supporting a second system, when a call for the first system is generated, and performing, by the second modem, digital signal processing of an audio signal for the first system.

BRIEF DESCRIPTION OF THE DRAWINGS

The above and other aspects, features and advantages of certain exemplary embodiments of the present invention will be more apparent from the following description taken in conjunction with the accompanying drawings, in which.

Throughout the drawings, like reference numerals will be understood to refer to like parts, components, and structures.

DETAILED DESCRIPTION OF EXEMPLARY EMBODIMENTS

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Exemplary embodiments of the present invention provide an apparatus and method for processing an audio signal transmitted/received through two networks by using a single modem in a dual standby mobile communication terminal. Hereinafter, for convenience in explanation, a microphone and a speaker will be described as a device for inputting/outputting the audio signal for example, but the present invention may also equally apply to other devices for inputting/ outputting the audio signal such as an earphone-microphone, a Bluetooth microphone, an earphone, a receiver, a Bluetooth earphone, and the like.

Figure 1:
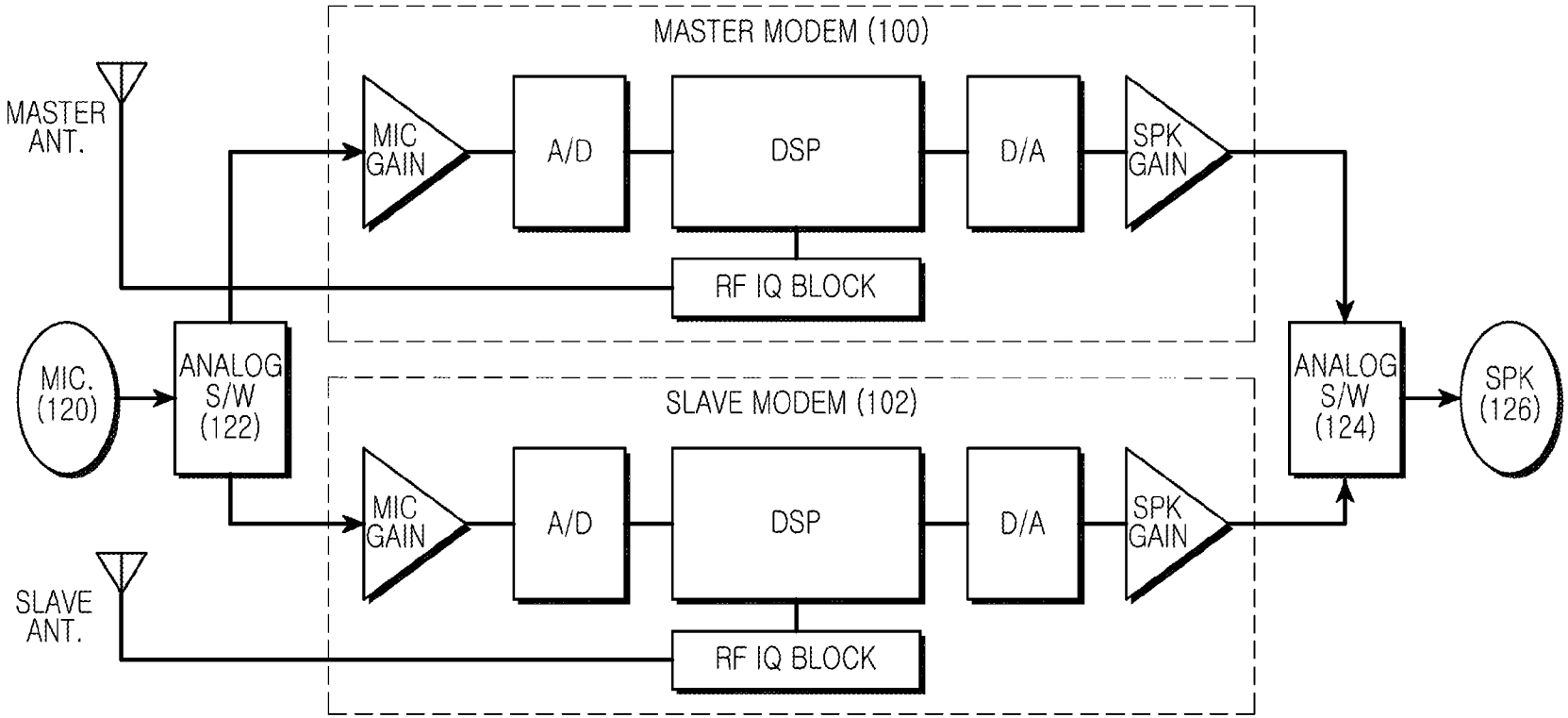
FIG. 1 RELATED ART
FIG. 1 is a block diagram illustrating a dual standby mobile communication terminal according to the related art.
Figure 2:
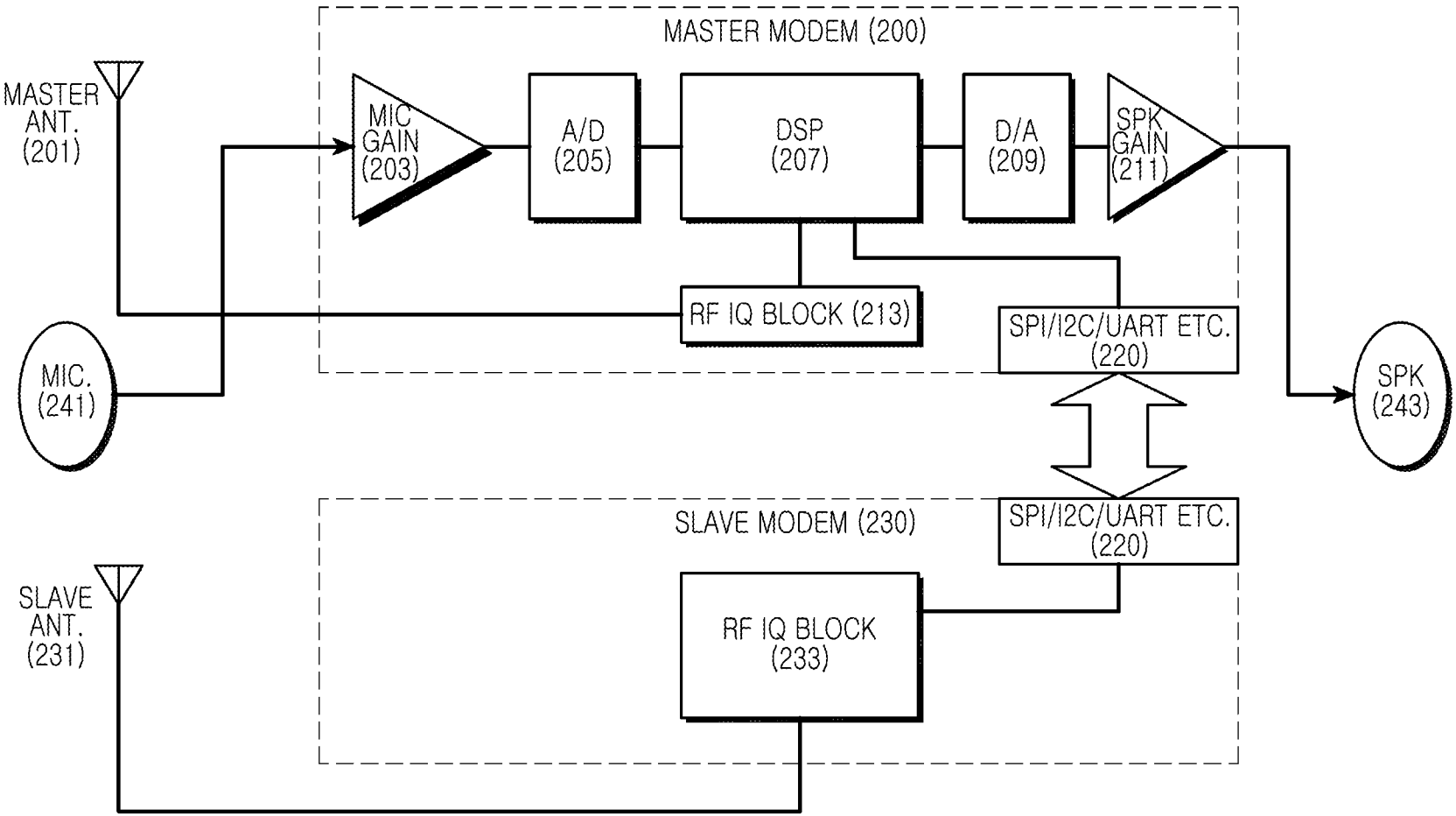
FIG. 2 is a block diagram illustrating a dual standby mobile communication terminal according to an exemplary embodiment of the present invention.

FIG. 2 is a block diagram illustrating a dual standby mobile communication terminal according to an exemplary embodiment of the present invention.

Referring to FIG. 2, the dual standby mobile communication terminal includes a master modem 200, a master antenna 201, a slave modem 230, a slave antenna 231, a microphone 241, and a speaker 243. The master modem 200 includes a Microphone (MIC) gain amplifier 203, an Analog to Digital (A/D) converter 205, a Digital Signal Processor (DSP) 207, a Digital to Analog (D/A) converter 209, a SPeaKer (SPK) gain amplifier 211, and a Radio Frequency (RF) In-phase/Quadrature (IQ) block 213. The slave modem 230 includes an RF IQ block 233. In an exemplary implementation, the master modem 200 and the slave modem 230 are connected through an interface 220 such as a Universal Asynchronous Receiver Transmitter (UART) interface, an Inter-Integrated Circuit (I2C) interface, a Serial Peripheral Interface (SPI), a Pulse Code Modulation (PCM) interface, and the like.

The master modem 200 modulates and demodulates a Transmit (Tx)/Receive (Rx) signal corresponding to a first system. In an exemplary implementation, the master modem 200 includes the MIC gain amplifier 203, the A/D converter 205, the DSP 207, the D/A converter 209, the SPK gain amplifier 211, and the RF IQ block 213, to output an audio signal received through the master antenna 201 to the speaker 243 by performing digital signal processing, and outputs an analog audio signal input from the microphone 241 to the master antenna 201 by performing the digital signal processing.

More particularly, when a call start interrupt signal is input through the interface 220 with the slave modem 230 according to an exemplary embodiment of the present invention, the master modem 200 receives an audio signal received through the slave antenna 231 from the slave modem 230 until a call end interrupt signal is input, outputs the input audio signal to the speaker 243 by performing the digital signal processing, and outputs an audio signal input from the microphone 241 to the slave modem 230 by performing the digital signal processing. In this case, the audio signal transmitted and received between the master modem 200 and the slave modem 230 is transmitted and received through the interface 220 such as the UART interface, the I2C interface, the SPI, the PCM interface, and the like.

That is, when the call start interrupt signal is input, the master modem 200 receives an IQ-demodulated audio signal from the slave modem 230 by using the DSP 207, and decodes the signal according to a preset rule. Thereafter, the master modem 200 converts the decoded audio signal into an analog signal by using the D/A converter 209, amplifies the analog-converted audio signal according to a preset gain of the speaker by using the SPK gain amplifier 211, and then outputs the amplified signal to the speaker 243.

In addition, when the call start interrupt signal is input, the master modem 200 amplifies an audio signal input from the microphone 241 according to a preset gain of the microphone by using the MIC gain amplifier 203, and then converts the signal into a digital signal by using the A/D converter 205. Thereafter, the master modem 200 encodes the digital audio signal by using the digital signal processor 207, and outputs the encoded audio signal to the RF IQ block 233 of the slave modem 230 through the interface 220.

The slave modem 230 modulates/demodulates a Tx/Rx signal corresponding to a second system. When a call event occurs by using a corresponding system according to an exemplary embodiment of the present invention, the slave modem 230 outputs an interrupt signal indicating a call start to the master modem 200, and thus requests the master modem 200 to process the Tx/Rx audio signal. That is, at the occurrence of the call event, the slave modem 230 outputs the interrupt signal indicating the call start to the master modem 200. Then, the slave modem 230 performs I/Q demodulation on an audio signal received through the slave antenna 231 by using the RF IQ block 233 and outputs the resultant signal to the master modem 200. Then, the slave modem 230 modulates an audio signal input from the master modem 200 by using the RF IQ block 233 and outputs the resultant signal to the slave antenna 231. In addition, when a call end event occurs by using the second system, the slave modem 230 outputs an interrupt signal indicating a call end to the master modem 200. In this case, the audio signal transmitted and received between the slave modem 230 and the master model 200 is transmitted and received through the interface 220 such as UART, I2C, SPI, PCM, and the like.

Figure 3:
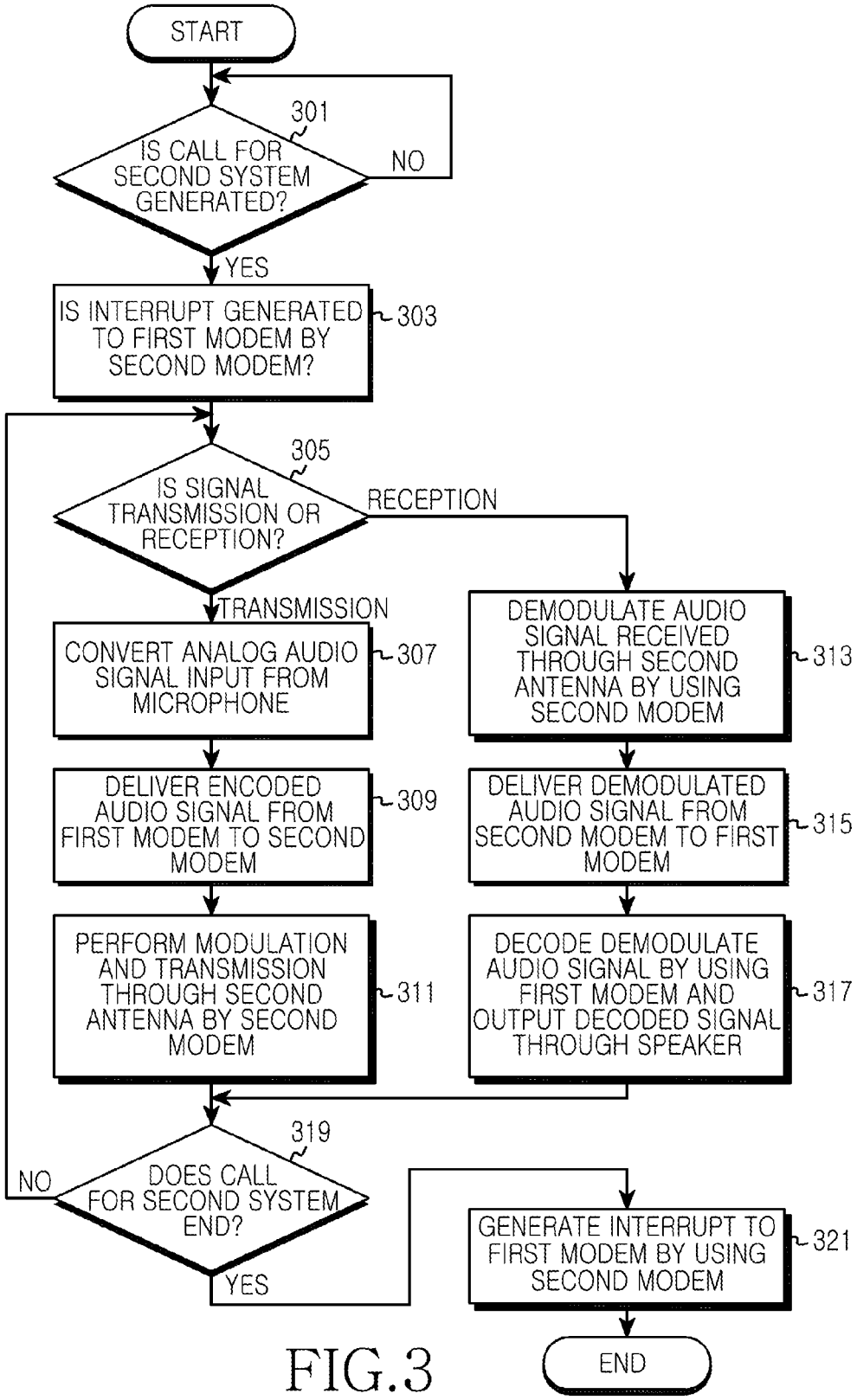
FIG. 3 is a flowchart illustrating an operation of a dual standby mobile communication terminal according to an exemplary embodiment of the present invention.

FIG. 3 is a flowchart illustrating an operation of a dual standby mobile communication terminal according to an exemplary embodiment of the present invention.

An exemplary modem supporting a first system is referred to as a first modem (or a master modem), and an exemplary modem supporting a second system is referred to as a second modem (or a slave modem). It is assumed herein that the first modem processes a Tx/Rx audio signal for the first system and the second system.

Referring to FIG. 3, the dual standby mobile communication terminal (hereinafter, simply referred to as a 'terminal') determines whether a call for the second system is generated in step 301. That is, the terminal determines whether the call is generated by using the second modem supporting the second system.

If the call for the second system is generated, proceeding to step 303, the terminal generates an interrupt signal indicating a call start for the second system to the first modem by using the second modem. In step 305, the terminal determines whether a signal to be processed at the moment is a Tx signal or an Rx signal.

If the signal to be processed is the Tx signal, the terminal converts an analog audio signal input from a microphone into a digital signal by using the first modem and then encodes the converted signal in step 307. In step 309, the terminal delivers the encoded audio signal from the first modem to the second modem. In step 311, the terminal performs I/Q modulation on the encoded audio signal by using the second modem, and transmits the I/Q-modulated audio signal through a second antenna connected to the second modem. In step 319, the terminal determines whether the call for the second system ends. If the call for the second system does not end, the operation returns to step 305 and the subsequent steps are repeated to continue the call for the second system.

On the other hand, if the call for the second system ends, the terminal generates an interrupt signal indicating a call end for the second system to the first modem by using the second modem in step 321, and then the procedure ends.

Meanwhile, if the signal to be processed is the Rx signal, by using the second modem, the terminal performs IQ demodulation on the audio signal received from the second antenna connected to the second modem in step 313. In step 315, the terminal delivers the IQ-demodulated audio signal from the second modem to the first modem. In step 317, the terminal decodes the delivered audio signal by using the first modem, and then converts the decoded signal into an analog signal and outputs the converted signal through a speaker.

In step 319, the terminal determines whether the call for the second system ends. If the call of the second system does not end, the operation returns to step 305 and the subsequent steps are repeated to continue the call for the second system.

Otherwise, if the call for the second system ends, the terminal generates the interrupt signal indicating the call end of the second system to the first modem by using the second modem in step 321, and then the procedure ends.

According to exemplary embodiments of the present invention, Tx/Rx audio signals of two networks are processed in a single modem. Therefore, manufacturing cost may be reduced since an analog switch is not used. Further, an audio signal path may be simply formed in an inner layer of a printed circuit board, thereby avoiding influence of external noise. Furthermore, there is an advantage in that voice telephony with constant quality may be performed in the two networks.

While the present invention has been shown and described with reference to certain exemplary embodiments thereof, it will be understood by those skilled in the art that various changes in form and details may be made therein without departing from the spirit and scope of the present invention as defined by the appended claims and their equivalents.

What is claimed is:

1. An apparatus for processing an audio signal in a dual standby mobile communication terminal, the apparatus comprising:

a first modem for supporting a first system and for outputting an interrupt signal that requests transmit/receive (Tx/Rx) audio signal processing in the dual standby mobile communication terminal when a call for the first system is generated; and a second modem for supporting a second system, for receiving the interrupt signal that requests the Tx/Rx audio signal processing from the first modem when the call for the first system is generated, and for performing digital signal processing of the Tx/Rx audio signal corresponding to the call for the first system using a Digital Signal Processor (DSP), wherein the first modem does not include the DSP and the second modem includes the DSP.

2. The apparatus of claim 1, further comprising:

an antenna for receiving the RX audio signal for the first system and for outputting the received signal to the first modem; and a speaker for outputting the Rx audio signal provided from the second modem, wherein the first modem demodulates the Rx audio signal received through the antenna and outputs the demodulated signal to the second modem, and wherein the second modem decodes the demodulated Rx audio signal provided from the first modem and outputs the decoded signal to the speaker.

3. The apparatus of claim 1, further comprising:

an antenna for transmitting the Tx audio signal provided from the first modem; and a microphone for receiving the Tx audio signal and for outputting the received Tx audio signal to the second modem, wherein the second modem encodes a Tx audio signal input from the microphone and outputs the encoded Tx audio signal to the first modem when the interrupt signal that requests the Tx/Rx audio signal processing is input from the first modem, and wherein the first modem modulates the encoded Tx audio signal and outputs the modulated Tx audio signal to the antenna.

4. The apparatus of claim 1, wherein the first modem and the second modem transmit/receive the Tx/Rx audio signal and the interrupt signal by using at least one of a Universal Asynchronous Receiver Transmitter (UART) interface, an Inter-Integrated Circuit (I2C) interface, a Serial Peripheral Interface (SPI), and a Pulse Code Modulation (PCM) interface.

5. The apparatus of claim 1, wherein the first modem outputs an interrupt signal indicating an end of the Tx/Rx audio signal processing when the call for the first system ends, and wherein the second modem receives the interrupt signal indicating the end of the Tx/Rx audio signal processing, and ends the Tx/Rx audio signal processing for the first system.

6. A method for processing an audio signal in a dual standby mobile communication terminal, the method comprising:

outputting, by a first modem supporting a first system, an interrupt signal that requests transmit/receive (Tx/Rx) audio signal processing in the dual standby mobile communication terminal to a second modem supporting a second system, when a call for the first system is generated; and performing, by a Digital Signal Processor (DSP) included in the second modem, digital signal processing of an Tx/Rx audio signal corresponding to the call for the first system when the call for the first system is generated, wherein the first modem does not include the DSP.

7. The method of claim 6, wherein the performing of the digital signal processing by the second modem comprises:

outputting, by the first modem, a demodulated Rx audio signal to the second modem by demodulating the Rx audio signal received from an antenna; and outputting, by the second modem, a decoded Rx audio signal to a speaker by decoding the demodulated Rx audio signal.

8. The method of claim 6, wherein the performing of the digital signal processing by the second modem comprises:

outputting, by the second modem, an encoded Tx audio signal to the first modem by encoding the audio signal inputted from a microphone; and outputting, by the first modem, a modulated Tx audio signal to the antenna by modulating the encoded Tx audio signal.

9. The method of claim 6, wherein the first modem and the second modem transmit/receive the Tx/Rx audio signal and the interrupt signal by using at least one of a Universal Asynchronous Receiver Transmitter (UART) interface, an Inter-Integrated Circuit (I2C) interface, a Serial Peripheral Interface (SPI), and a Pulse Code Modulation (PCM) interface.

10. The method of claim 6, further comprising, when the call for the first system ends, outputting, by the first modem, an interrupt signal indicating an end of the Tx/Rx audio signal processing to the second modem.

11. An apparatus for processing an audio signal in a dual standby mobile communication terminal, the apparatus comprising:

an antenna for receiving a receive (Rx) audio signal for a first system, for outputting the Rx audio signal to a first modem and for transmitting a transmit (Tx) audio signal provided from the first modem;

the first modem supporting the first system and for outputting an interrupt signal that requests transmit/receive (Tx/Rx) audio signal processing in the dual standby mobile communication terminal when a call for the first system is generated;

a second modem for supporting a second system, for receiving the interrupt signal that requests the Tx/Rx audio signal processing from the first modem when the call for the first system is generated, and for performing digital signal processing of the Tx/Rx audio signal corresponding to the call for the first system using a Digital Signal Processor (DSP); and a microphone for receiving the Tx audio signal and for outputting the received Tx audio signal to the second modem, wherein the first modem does not include the DSP and the second modem includes the DSP.

12. The apparatus of claim 11, wherein the Rx audio signal provided from the second modem is output by a speaker.

13. The apparatus of claim 12, wherein the first modem demodulates the Rx audio signal received through the antenna and outputs the demodulated Rx audio signal to the second modem, and wherein the second modem decodes the demodulated Rx audio signal provided from the first modem and outputs the decoded Rx audio signal to the speaker.

14. The apparatus of claim 12, wherein the second modem encodes an Tx audio signal inputted from the microphone and outputs the encoded Tx audio signal to the second modem when the interrupt signal that requests the Tx/Rx audio signal processing is input from the first modem, and wherein the first modem modulates the encoded Tx audio signal and outputs the modulated Tx audio signal to the antenna.

15. The apparatus of claim 11, wherein the first modem and the second modem transmit/receive the Tx/Rx audio signal and the interrupt signal by using at least one of a Universal Asynchronous Receiver Transmitter (UART) interface, an Inter-Integrated Circuit (I2C) interface, a Serial Peripheral Interface (SPI), and a Pulse Code Modulation (PCM) interface.

16. The apparatus of claim 11, wherein the first modem outputs an interrupt signal indicating an end of the Tx/Rx audio signal processing when the call for the first system ends, and wherein the second modem receives the interrupt signal indicating the end of the Tx/Rx audio signal processing, and ends the Tx/Rx audio signal processing for the first system.

* * * * *